US005644981A

United States Patent [19]

Ohno et al.

[11] Patent Number: 5,644,981

[45] Date of Patent: Jul. 8, 1997

[54] ABNORMALITY DETECTOR FOR NOZZLE TYPE DAMPENING SYSTEMS

[75] Inventors: Kinichiro Ohno, Machida; Noboru Fujio, Hamura; Tamaki Ohkawara, Kawasaki, all of Japan

[73] Assignee: Tokyo Kikai Seisakusho, Ltd., Tokyo, Japan

[21] Appl. No.: 554,002

[22] Filed: Nov. 6, 1995

[30] Foreign Application Priority Data

Apr. 3, 1995 [JP] Japan ..... 7-077588

[51] Int. Cl.[6] ..... B41F 7/24

[52] U.S. Cl. ..... 101/147; 101/425; 101/132.5

[58] Field of Search ..... 101/147, 148, 101/365, 366, 424, 425, 132.5; 118/259

[56] References Cited

U.S. PATENT DOCUMENTS

| | | | |
|---|---|---|---|
| 4,151,854 | 5/1979 | Patsko | 101/147 X |
| 4,649,818 | 3/1987 | Switall et al. | 101/147 |
| 4,708,058 | 11/1987 | Smith | 101/147 |
| 5,050,994 | 9/1991 | Kipphan et al. | 356/445 |
| 5,505,126 | 4/1996 | Ohno et al. | 101/147 |

FOREIGN PATENT DOCUMENTS

| | | | |
|---|---|---|---|
| 51-59511 | 5/1976 | Japan . | |
| 57-18255 | 1/1982 | Japan . | |
| 58-49252 | 3/1983 | Japan . | |
| 1-110146 | 4/1989 | Japan . | |
| 4-74910 | 3/1992 | Japan . | |
| 5-330009 | 12/1993 | Japan . | |
| 0106231 | 12/1993 | Japan | 101/147 |
| 0941214 | 7/1982 | U.S.S.R. | 101/147 |

*Primary Examiner*—Christopher A. Bennett
*Attorney, Agent, or Firm*—McGlew and Tuttle

[57] ABSTRACT

An abnormality detector for nozzle-type dampening systems in offset printers, for injecting dampening solution through nozzles onto a receiving part by intermittently opening nozzles with nozzle opening signals generated by a nozzle operation controller, which detects the abnormal injection of dampening solution through the dampening system nozzles is disclosed. The abnormality detector comprises electrically conductive members provided in a dampening solution flying zone between the nozzles and the receiving part, a dampening solution stream detecting means for detecting a voltage generated in accordance with the state of dampening solution injection between the nozzles and the electrically conductive members, a comparing means for comparing a detecting signal generated from the injected dampening solution detecting means with a predetermined threshold value, an intermediate processing means that is brought into a signal outputt state with a nozzle opening signal generated from a nozzle operation controller, and releases the signal output state with an output signal from the comparing means, and an abnormality judgment means for generating an abnormality judgment signal when a nozzle opening signal is received from the nozzle operation controller under the state where the output signal is being received from the intermediate processing means.

7 Claims, 5 Drawing Sheets

ABNORMALITY DETECTOR FOR NOZZLE TYPE DAMPENING SYSTEMS

BACKGROUND OF THE INVENTION

This invention relates generally to an abnormality detector for nozzle-type dampening systems, and more particularly to an abnormality detector for nozzle-type dampening systems in offset printers for detecting abnormal injection of dampening solution.

In offset printing, a plate having virtually no irregularities and formed in such a manner that its printing image area is lipophilic and its non-image area is hydrophilic is used, both dampening solution chiefly consisting of water and oily ink are fed onto the plate surface, and the ink is allowed to be fed only onto the printing image area by taking advantage of the mutual repellency of water and oil. The dampening system can be roughly divided into two types of mechanism; one is a mechanism where a roller train is provided which extends from the dampening solution reservoir to the plate surface; one rotating roller partly dipped into the solution carries it from the reservoir to the plate surface via the adjacent roller contact surfaces. This allows the dampening solution to be fed in a thin film over the entire axial roller surface.

With this mechanism, however, it is difficult to change the feed of the dampening solution onto different axial areas of the roller. In addition, the ink entering from the plate surface to the dampening solution reservoir via a continuous roller train may contaminate the dampening solution.

Another mechanism is such that the above inconvenience is overcome by dividing the source of the dampening solution into the plate surface and the roller train extending to the plate surface so that the feed of the dampening solution can be changed onto the different areas of the roller by causing the dampening solution to fly toward the plate surface and the roller train extending to the plate surface. Included in this type of mechanism are the nozzle-type dampening arrangements in which the dampening solution is injected through the nozzles, as disclosed in Published Unexamined Japanese Patent Application Nos. Sho-51 (1976)-59511, Hei-1(1989)-110146 and Hei-5(1993) 330009, for example.

Published Unexamined Japanese Patent Application No. Sho-51(1976)-59511 discloses a dampening arrangement in which the amount of dampening solution regulated by a metering pump is fed to each of a plurality of nozzles; the dampening solution being atomized by a rapid air stream created by the air supplied by a blower. In this dampening arrangement, the metering pump is operated at a desired speed corresponding to the speed of the printer by controlling the operation of its drive motor.

Published Unexamined Japanese Patent Application No. Hei-1(1989)-110146 discloses a dampening arrangement which comprises a pump unit for feeding dampening solution, nozzles for injecting the dampening solution fed from the pump unit, and a controller for controlling the injection of the dampening solution from the nozzles in accordance with the printing speed of the printer. In this dampening arrangement, the injection of the dampening solution is controlled by opening the nozzles for a predetermined time at the timing of injection of the dampening solution calculated from a basic value that is a preset and stored value, an adjustment value that is set in accordance with the printing elements corresponding to each of the injection nozzles, and a corrected value that is a preset and stored value for different printing speed of the printer by relating them to the revolution of a plate cylinder of the printer. That is, control is effected so that a predetermined amount of the dampening solution is injection as the plate cylinder of the printer is rotated by the value calculated above.

Though no specific details have not been disclosed, it is stated in this Patent Application that the duration of injection, that is, the amount of injection of dampening solution may be controlled by changing nozzle opening time or injection pressure, and that the amount of injection of dampening solution may be controlled by changing the opening area of a shutter member provided in front of the nozzles.

Published Unexamined Japanese Patent Application No. Hei-5(1993)-330009 discloses a dampening arrangement comprising a speed detecting means for detecting the printing speed of a printer, a memory for storing the feed of dampening solution to be fed in accordance with printing conditions and the printing speed of the printer, an injecting means having a plurality of nozzles connected by tubing to a source of dampening solution and an air source for continuously injecting onto the plate surface or the surface of the roller coming in contact with the plate surface the dampening solution atomized by a rapid air stream, and a pressure control means provided in the tubing connecting the source of dampening solution and the injecting means for controlling the feeding pressure of dampening solution to the injecting means in accordance with the feed of dampening solution stored in the memory.

In this dampening arrangement, the amount of injection of dampening solution is controlled by setting the feed of dampening solution in accordance with printing speed and printing conditions, such as humidity and temperature, and keeping constant the pressure of dampening solution delivered to the downstream side of the pressure control means by comparing the set feed of dampening solution with the pressure value in the tubing on the downstream side of the pressure control means. In addition, it is also stated in Published Unexamined Japanese Patent Application No. Hei-5(1993)-330009 that a needle valve is provided on the upstream side of each nozzle to fine control the feed of the dampening solution, thereby the feed of the dampening solution can be accurately given.

The prior art pertaining to the checking of the feeding state of dampening solution includes Published Unexamined Japanese Patent Application Nos. Sho-57(1982)-18255, Sho-58(1983)-49252, and Hei-4(1992)-74910.

Published Unexamined Japanese Patent Application Nos. Sho-57(1982)-18255 and Sho-58(1983)-49252 disclose the technology where a roller having a water-containing layer on the surface and electrodes on the inside surface coming in contact with the water-containing layer is provided in a roller train for feeding dampening solution to the plate surface, and the content of dampening solution in the water-containing layer of the roller is checked by obtaining an electric resistance value of the roller water-containing layer or an impedance value across the electrodes.

Published Unexamined Japanese Patent Application No. Hei-4(1992)-74910 discloses the technology where parallel light is shone on the plate surface to which dampening solution is fed, and the reflected light is received and converted into a voltage value based on which the thickness of the dampening solution on the plate surface is calculated.

The prior art, as disclosed in these Japanese Patent Applications, involves the checking of the feeding state of dampening solution on the roller on the mid-stream and downstream of the dampening arrangement, or on the plate surface to which the dampening solution is fed from the dampening arrangement, and has no function for directly checking the feeding state of dampening solution from the nozzles on the upstream side of the dampening arrangement.

The nozzles used in the nozzle-type dampening arrangement are generally of a type where dampening solution is injected in mist form through an extremely narrow opening.

Dampening solution is usually water or water to which a surface tension decreasing agent is added, which tends to include impurities through the generation of salts due to chemical reactions of metallic ions in the solution, the generation of organisms such as bacteria or fine algae, or infiltration of solid particles such as paper powder.

Furthermore, the nozzle-type dampening arrangement, which involves the feeding of the dampening solution slightly pressurized by a pump to the nozzles from the reservoir via tubing in which an appropriate filter is provided, tends to have insoluble matter infiltrated in the feeding path through the filter to the nozzle opening for some reason or other, resulting in the clogging of the nozzle opening preventing the dampening solution from being injected. This leads to poor printing due to the inadequate feeding amount of dampening solution.

It has therefore been desired to create an arrangement for checking the state of dampening solution injected through the nozzles.

SUMMARY OF THE INVENTION

It is an object of this invention to provide an abnormality detector for nozzle-type dampening systems in which the feeding state of dampening solution from the nozzles on the upstream side of the dampening system is checked for each nozzle to quickly detect abnormality, thereby preventing improper printing or deterioration of printing quality caused by abnormal injection of dampening solution injected through the nozzle to ensure good printing quality. It is another object of this invention to provide a small-sized, durable abnormality detector by employing semiconductor circuit elements, such as a comparator/amplifier, a flip-flop circuit and an AND circuit.

DETAILED DESCRIPTION OF EMBODIMENTS

Figure 1:
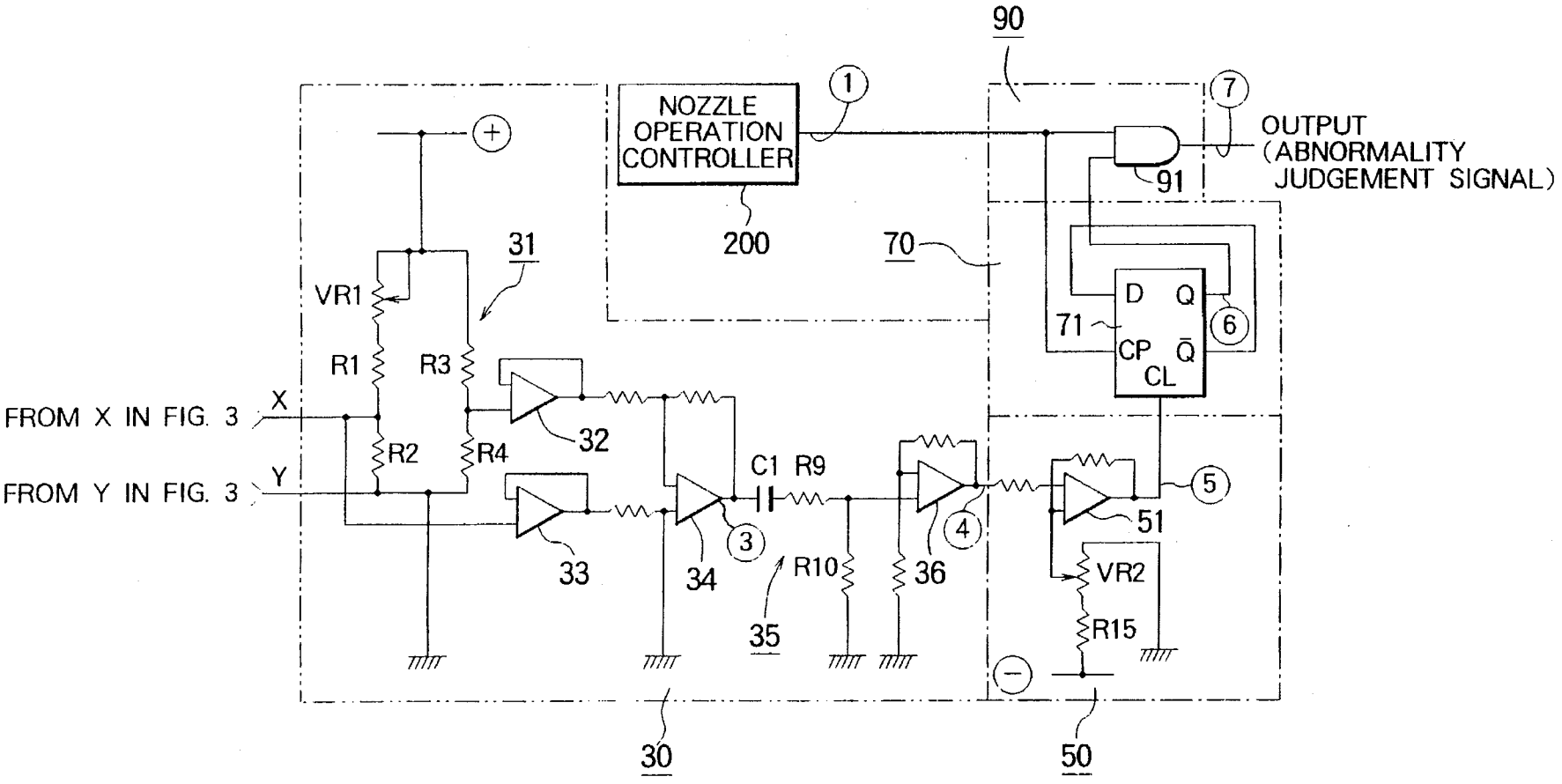
FIG. 1 shows the construction of an embodiment of abnormality detector for nozzle-type dampening systems according to this invention.

Before description is made on the construction of an embodiment of abnormality detector for nozzle-type dampening systems according to this invention, as shown in FIG. 1, a lithographic printer to which this invention is applied will be described, referring to FIGS. 5 and 6.

Figure 5:
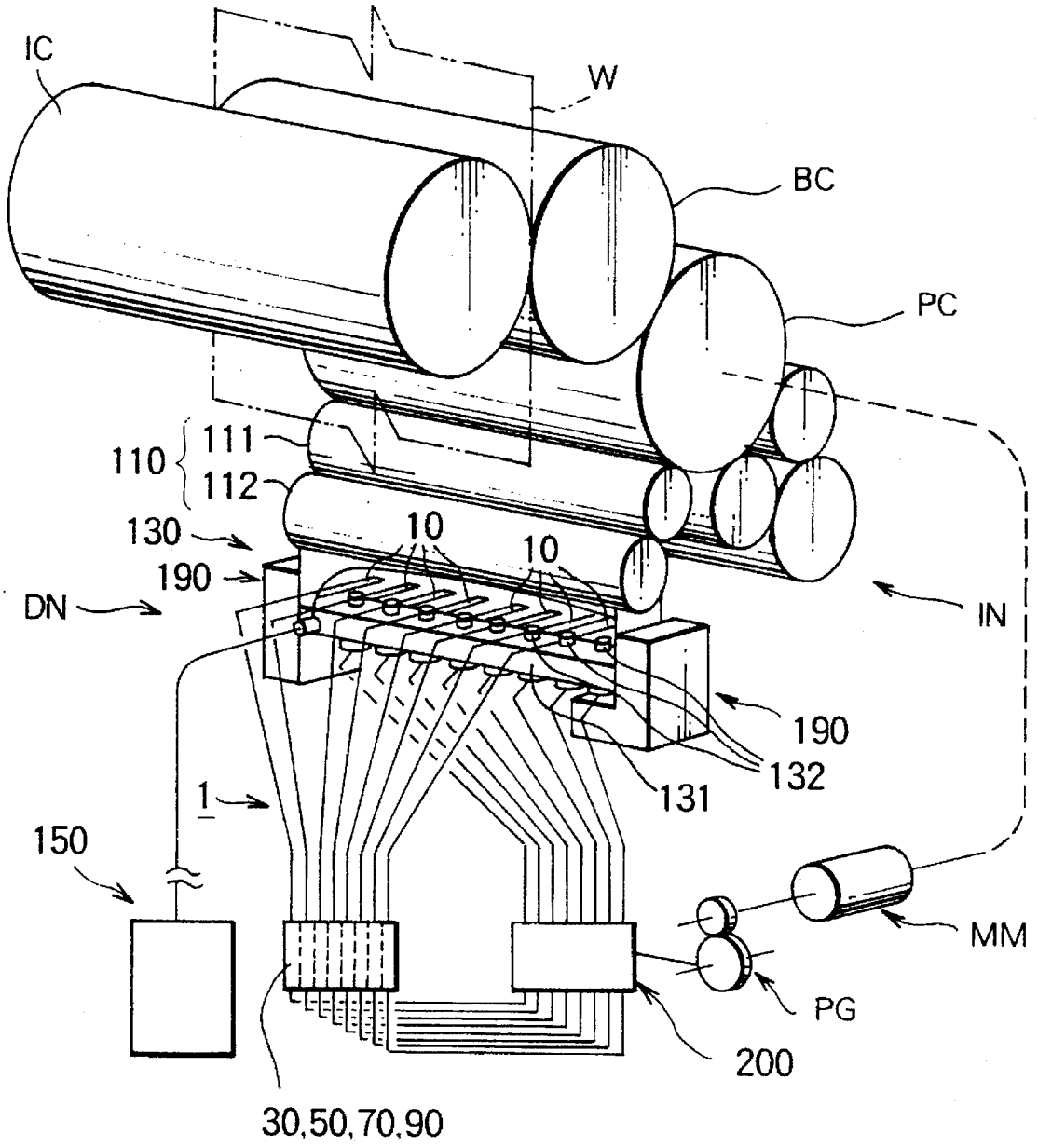
FIG. 5 is a perspective view illustrating the outlined construction of an example of lithograph printer having a nozzle-type dampening system.

FIG. 5 is a perspective view illustrating the outlined construction of a lithographic printer having a nozzle-type dampening system. FIG. 6 is a diagram of assistance in explaining the distribution areas over the upstream roller surface of dampening solution injected through the nozzles of the nozzle-type dampening system shown in FIG. 5.

The lithographic printer uses a plate (not shown) consisting of a lipophilic printing image area and a hydrophilic non-image are and mounted on a plate cylinder PC, feeds to the plate surface an appropriate amount of ink by an inking device IN (only the side faces of the rollers are shown with the upstream side omitted in FIG. 5) and an appropriate amount of dampening solution by a dampening system DN, and prints printing elements on a web W threaded between a blanket cylinder BC and an impression cylinder IC via the surface of a blanket (not shown) fitted to the blanket cylinder (BC) by a method based on the conflicting physical properties of the printing image and non-image areas of the plate surface and on the mutual repulsion between the dampening solution chiefly consisting of water and the oily ink.

A dampening system DN on which an abnormality detector 1 that is an embodiment of this invention is mounted comprises a roller means 110 having a contact area with the plate, and a nozzle means 130 for injecting dampening solution onto predetermined portions of the roller means 110.

The roller means 110 has a downstream roller 111 that rotates keeping in contact with the plate, and an upstream roller 112 that rotates keeping in contact with the downstream roller 111 and is a receiving part of the dampening solution injected through the nozzle means 130, both rollers disposed in virtually parallel with each other.

The nozzle means 130 has a tubular member 131 provided in virtually parallel with the axis of the upstream roller 112, and a plurality of (eight in the figure) nozzles 132 provided on the tubular member 131 at almost equal intervals. Both sides of the nozzle means 130 in the longitudinal direction are supported by a frame (not shown) by a displacement means 190.

Figure 6:
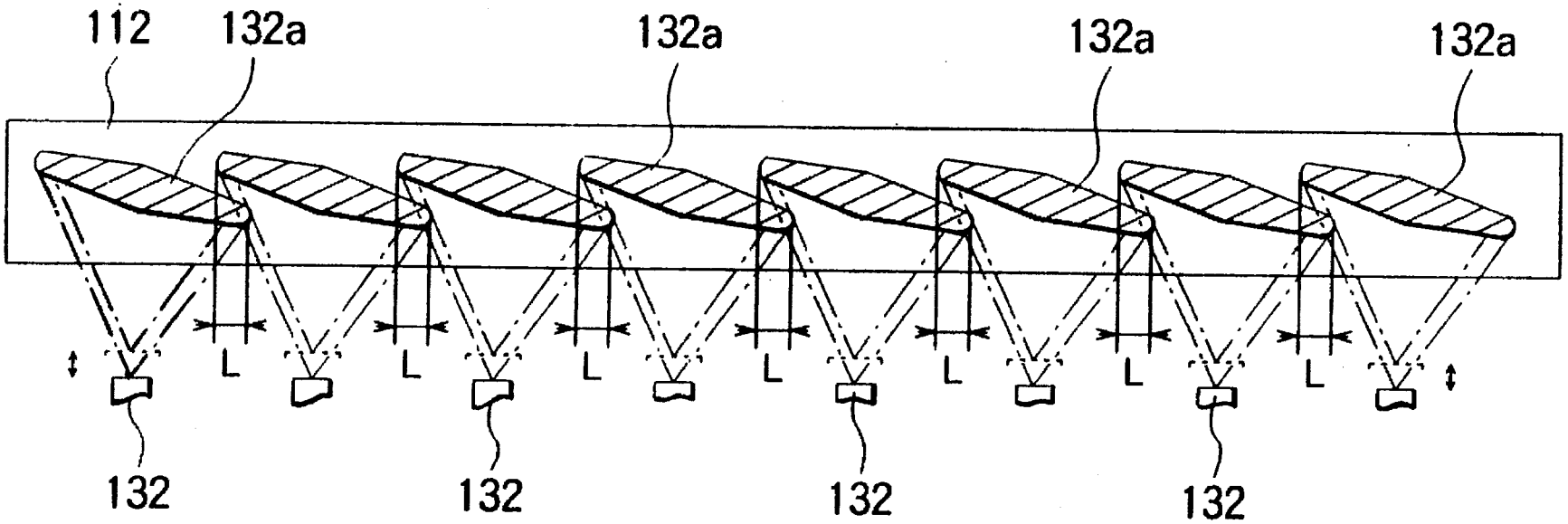
FIG. 6 is a diagram of assistance in explaining the distribution areas over the upstream roller surface of dampening solution injected through the nozzles of the nozzle-type dampening system shown in FIG. 5.

The displacement means 190 is used for adjusting the axially overlapped area L of dampening solution distribution areas 132*a* (hatched areas) on the surface of the upstream roller 112 shown in FIG. 6 by moving the nozzles 132 closer to or away from the surface of the upstream roller 112.

To the tubular member 131 connected is a dampening solution feeding means 150 to feed dampening solution in pressurized state.

The nozzle 132 is of such a type that can inject dampening solution in such a manner as to spread in an oval shape. The nozzles 132 are disposed so that dampening solution can be injected in such a manner that the major axes of the elliptical dampening solution distribution areas 132*a* on the surface area of the upstream roller 112 are disposed obliquely with respect to the axis of the upstream roller 112 and yet in parallel with each other, as shown in FIG. 6.

The nozzle 132 is provided in such a manner that the inlet of dampening solution is opened toward the tubular member 131, and the dampening solution injection hole faces toward the surface of the upstream roller 112. A valve member (not shown) closing the dampening solution injection hole opens the injection hole by the excitation of a solenoid (not shown), and is restored to a position to close the injection hole by the force of a spring (not shown) after the completion of excitation.

The solenoid of the nozzle 132 is controlled by a nozzle operation controller 200, and the injection hole of the nozzle 132 is opened intermittently by a nozzle opening signal generated by the nozzle operation controller 200 at a predetermined timing.

The abnormality detector 1 has at least one electrically conductive member 10 in the flying area of the dampening solution injected from each nozzle 132 between the nozzles 132 and the upstream roller 112 as the receiving part of the dampening solution injected through the nozzles 132 so that electrical continuity can be established between the nozzles 132 and the electrically conductive member 10 via the flying dampening solution, and an injected dampening solution detecting means 30 which generates an injected dampening solution detection signal of a voltage corresponding to the intensity of current when continuity is brought between the nozzles 132 and the electrically conductive member 10.

A comparing means 50 which receives the injected dampening solution detection signal, and outputs an injected dampening solution detection secondary signal when the potential of the signal, that is, the signal level exceeds the reference voltage level of a predetermined threshold value L is provided, and an intermediate processing means 70 which receives the aforementioned nozzle opening signal and outputs a signal, holds the signal output state, and releases the signal output state upon receiving the injected dampening solution detection secondary signal is provided. Furthermore, an abnormality judgment means 90 which receives the output signal of the intermediate processing means 70 and the nozzle opening signal, and produces an abnormality judgment signal when both the signals overlap is also provided. Symbols MM refers to a printer drive means, and PG to a means for generating a signal relating to the driving state.

Figure 2:
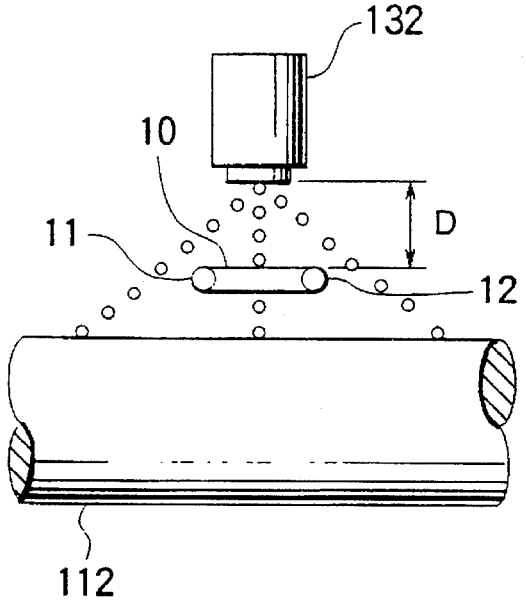
FIG. 2 is a diagram of assistance in explaining the mechanism of an example of abnormality detecting part of injected dampening solution.
Figure 3:
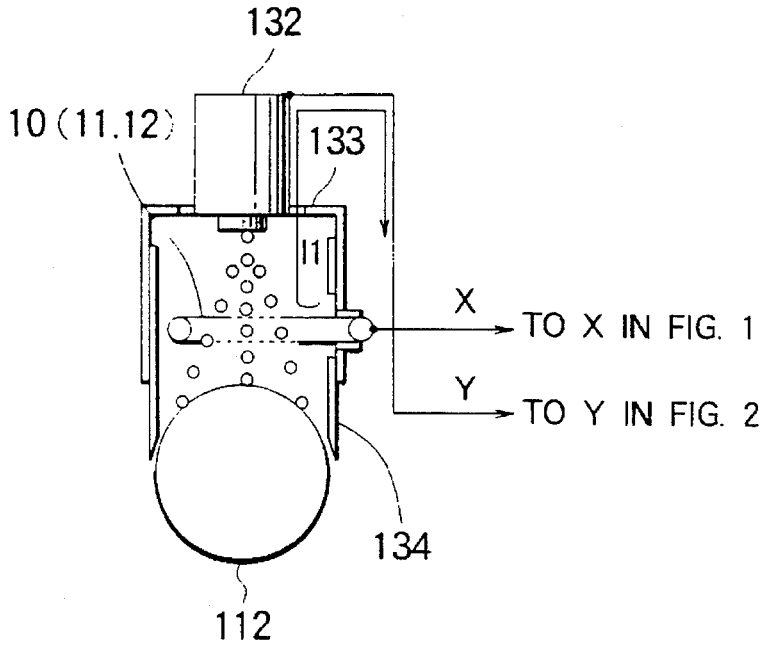
FIG. 3 is a side view of the mechanism part of FIG. 2.

Now, the abnormality detector 1 which is an embodiment of this invention will be described in more detail, referring to FIGS. 1, 2 and 3. FIGS. 1, 2 and 3 show an abnormality detector 1 corresponding to one nozzle 132.

The electrically conductive member 10 has a rectangular loop shape, and is disposed so that the long sides 11 and 12 thereof make almost right angles with respect to the direction of the axis of the upstream roller 112 and cross the dampening solution flying area at a location a distance D away from the tip of the nozzle 132. the center of both long sides 11 and 12 agrees with the center of the dampening solution flying area, and that the distance D from the tip of the nozzle 132 does not change even when the nozzle 132 is moved. For example, the electrically conductive member 10 is installed on an outer cover 133 which moves following the movement of the nozzle 132, passed through an inner cover 134 in a movable manner with respect to the inner cover 134, and insulated from either of the outer and inner covers 133 and 134.

In the injected dampening solution detecting means 30, a current bridge circuit 31 is formed by connecting resistors VR1, R1, R2, R4 and R3 sequentially to form a loop, connecting a voltage supply portion for supplying positive voltage between the resistors VR1 and R3, grounding one end each of the resistors R2 and R4, connecting the electrically conductive member 10 between the resistors R1 and R2, and connecting a voltage follower 32 between the resistors R4 and R3.

Furthermore, the nozzle 132 is connected between the resistors R2 and R4, and the electrically conductive member is connected to the input end of another voltage follower 33. Furthermore, an electrical circuit is formed by connecting the output ends each of the voltage followers 32 and 33 to separate input ends of a comparator/amplifier 34, and connecting an output end of the comparator/amplifier 34 to an input end of an amplifier 36 via a differentiation circuit 35 comprising a capacitor C1, a resistors R9 and R10.

A comparing means 50 comprises a comparator/amplifier 51 one input end of which is connected to an output end of the amplifier 36 of the injected dampening solution detecting means 30, and another input end of which is connected to a negative voltage supply portion via resistors R15 and VR2 for regulating the reference voltage level as the threshold value L.

An intermediate processing means 70 comprises a flipflop circuit 71, a clear CL input end of which is connected to an output end of the comparator/amplifier 51 of the comparing means 50, and a clock-pulse CP input end of which is connected to a nozzle opening signal output end of a nozzle operation controller 200.

An abnormality judgment means 90 comprises an AND circuit 91, one input end of which connected to an output end Q of the flipflop circuit 71 of the intermediate processing means 70, and another input end of which is connected a nozzle opening signal output end of the nozzle operation controller 200.

The operation of the abnormality detector in nozzle-type dampening systems according to this invention having the aforementioned construction will be described in the following.

Figure 4:
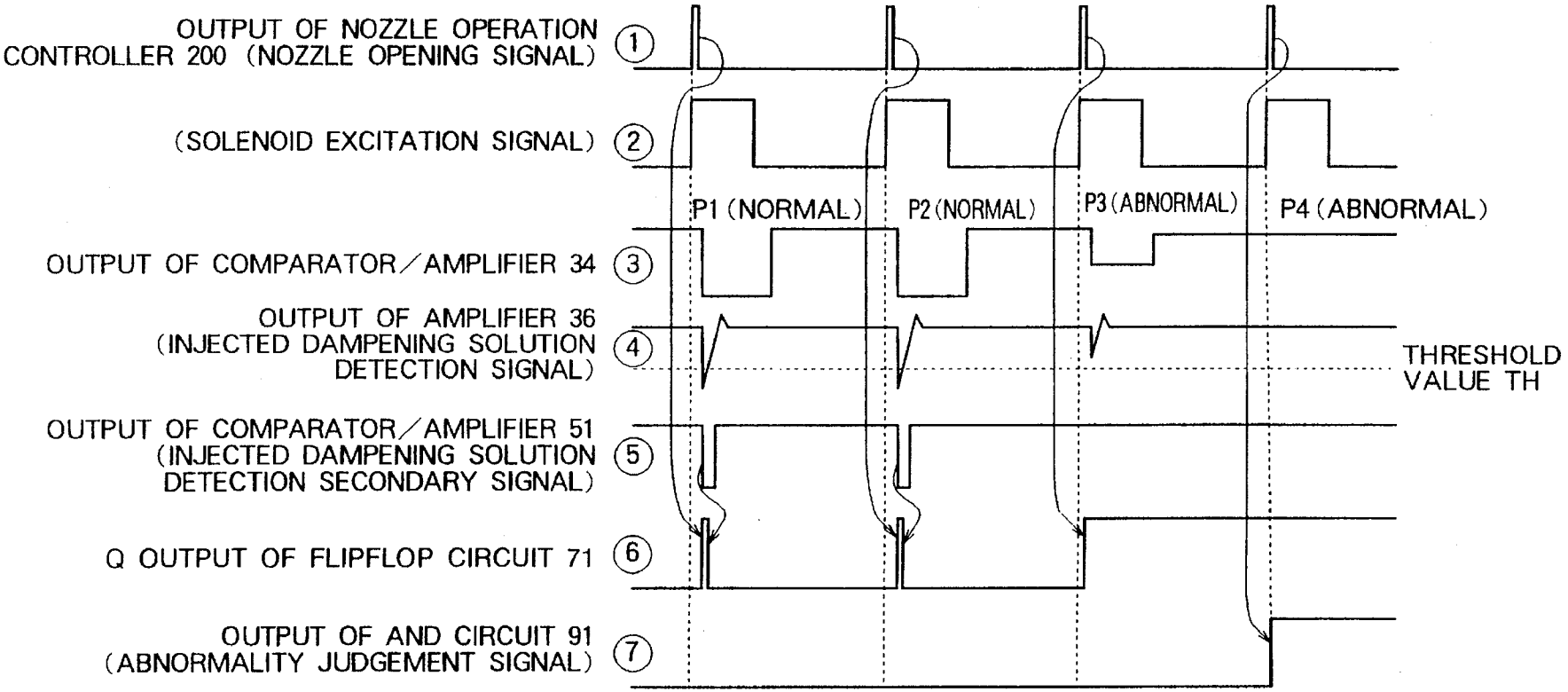
FIG. 4 is a time chart illustrating the operation of an embodiment of abnormality detector for nozzle-type dampening systems according to this invention.

As the printer begins operation, the nozzle operation controller 200 outputs a nozzle opening signal ((1) in FIG. 4) at a predetermined timing to inject dampening solution through the nozzle 132, and the nozzle operation controller 200 outputs a solenoid excitation signal ((2) in FIG. 4) only for a predetermined period of time counted by a timer in the nozzle operation controller 200, which is operated by the nozzle opening signal. With this solenoid excitation signal, an injection hole of the nozzle 132 is opened to inject the dampening solution in mist form.

As the dampening solution is injected, continuity is established between the nozzle 132 and the electrically conductive member 10, and current $I_1$ flows between the nozzle 132 and the electrically conductive member 10, thereby a resistance across X and Y terminals of the current bridge circuit 31 becomes parallel with a resistance produced between the nozzle 132 and the electrically conductive member 10. Assuming the resistance value of the resistor R2 is R2r, and the resistance value between the nozzle 132 and the electrically conductive member 10 is R0r, the resistance value Rr across the X and Y terminals in the current bridge circuit 31 is $$Rr=(R0r\times R2r)/(R0r+R2r)$$

where R0r corresponds with changes in conductivity that changes with the state of the dampening solution mist injected through the nozzle 132 in the dampening solution flying area.

Consequently, as the dampening solution is injected through the nozzle 132, the voltage entered into the voltage follower 32 remains unchanged, and as a result, the output voltage from the voltage follower 32 remains constant, while the voltage entered into the voltage follower 33 changes, and as a result, the output voltage from the voltage follower 33 also changes, and assumes various values with the state of injected dampening solution. The output signals generated from these two voltage followers 32 and 33 are entered into the comparator/amplifier 34.

The comparator/amplifier 34 compares and amplifies the voltages of signals entered from the voltage followers 32 and 33, and outputs a voltage signal shown in (3) of FIG. 4, for example. In FIG. 4, waveforms P1 and P2 represent the state of output when the injection of dampening solution is normal, while a waveform P3 represents the state of output when the injection of dampening solution is abnormal and a waveform P4 represents the state of output when there is no injection of dampening solution. In this way, the signal level changes with the state of injection of dampening solution. The output signal of the comparator/amplifier 34 is entered into the amplifier 36 via the differentiation circuit 35.

The amplifier 36 outputs an injected dampening solution detection signal that is the voltage signal shown by (4) of FIG. 4 in response to an input signal. This injected dampening solution detection signal is entered into an input end of the comparator/amplifier 51.

In one of the input end of the comparator/amplifier 51 entered is the injected dampening solution detection signal, as described above, where a reference voltage that is the threshold value adjusted and set by the resistor R15 and VR2 is entered into another input end thereof. The comparator/amplifier 51 outputs an injected dampening solution detection secondary signal that is the voltage signal shown in (5) of FIG. 4, for example, when the voltage of the injected dampening solution detection signal entered from the amplifier 36 exceeds the reference voltage level of the threshold vale TH entered from the voltage supply portion, that is, when the level of the injected dampening solution detection signal is less than the reference voltage level of the threshold value TH.

The nozzle opening signal generated by the nozzle operation controller 200, on the other hand, is entered into the flipflop circuit 71 and the AND circuit 91.

The output end Q of the flipflop circuit 71 is reversed from the "LOW" state to the "HIGH" state (hereinafter referred to as L and H in short) with the "fall" of the pulse of the nozzle opening signal ((6) in FIG. 4), and this H signal is entered into the AND circuit 91. The flipflop circuit 71 is reversed from the H state to the L state and released when the injected dampening solution detection secondary signal generated by the comparator/amplifier 51 is entered into the flipflop circuit 71.

The AND circuit 91 outputs an abnormality judgment signal shown by (7) in FIG. 4, for example, when the nozzle opening signal and the H signal at the output end Q of the flipflop circuit 71 are entered, and when the H signal of the nozzle opening signal and the H signal of the flipflop circuit 71 are entered simultaneously.

Consequently, when a solenoid excitation signal is generated with the preceding nozzle opening signal generated by the nozzle operation controller 200, for example, the nozzle 132 is opened to inject dampening solution. When the dampening solution is injected normally, continuity is established between the nozzle 132 and the electrically conductive member 10. Then, the amplifier 36 of the injected dampening solution detecting means 30 outputs an injected dampening solution detection signal.

The voltage level of this injected dampening solution detection signal is well above the reference voltage level of the preset threshold value TH, that is, below the reference voltage level of the threshold value TH in FIG. 4. The comparator/amplifier 51 of the comparing means 50 that receives this injected dampening solution detection signal outputs an injected dampening solution detection secondary signal.

The preceding nozzle opening signal, on the other hand, is entered into the flipflop circuit 71 of the intermediate processing means 70 and the AND circuit of the abnormality judgment means 90.

Then, the output end Q of the flipflop circuit 71 of the intermediate processing means 70 is turned to the H state with the "fall" of the pulse of the nozzle opening signal. The H signal at the output end Q of the flipflop circuit 71 is entered into the AND circuit 91 of the abnormality judgment means 90 lagging slightly behind the preceding nozzle opening signal. The aforementioned injected dampening solution detection secondary signal is entered into the flipflop circuit 71, which releases the H state at the output end Q of the flipflop circuit 71. This release stops the inputting of signals from the flipflop circuit 71 to the AND circuit 91.

When the preceding nozzle opening signal is entered, the AND circuit 91 of the abnormality judgment means 90 does not output any abnormality judgment signal because the H signal of the flipflop circuit 71 of the intermediate processing means 70 is not entered as yet.

Next, a succeeding nozzle opening signal is generated by the nozzle operation controller 200 to perform the same operations as described above.

When the injection of dampening solution from the nozzle 132 is not normal, the nozzle operation controller 200 operates in the following manner.

When a solenoid excitation signal is generated by the preceding nozzle opening signal generated by the nozzle operation controller 200, the nozzle 132 is opened. However, if dampening solution is not injected normally from the opened nozzle 132, no continuity is established between the nozzle 132 and the electrically conductive member 10, no injected dampening solution detection signal is produced by the amplifier 36 of the injected dampening solution detecting means 30, or even if continuity is established between the nozzle 132 and the electrically conductive member 10, only a feeble current flows. Thus, the amplifier 36 of the injected dampening solution detecting means 30 outputs an injected dampening solution detection signal of a level that cannot be higher than the reference voltage level of the threshold value TH. That is, the injected dampening solution detection signal never be less than the reference level of the threshold level TH in FIG. 4.

Consequently, the comparator/amplifier 51 of the comparing means 50 connected to the amplifier 36 of the injected dampening solution detecting means 30 does not output any injected dampening solution detection secondary signal.

The preceding nozzle opening signal, on the other hand, is entered into the flipflop circuit 71 of the intermediate processing means 70 and the AND circuit 91 of the abnormality judgment means 90.

Then, the output end Q of the flipflop circuit 71 of the intermediate processing means 70 is turned to the H state with the "fall" of the pulse of the nozzle opening signal. The H signal at the output end Q of the flipflop circuit 71 is entered into the AND circuit of the abnormality judgement means 90 lagging slightly behind the preceding nozzle opening signal. Since dampening solution is not injected normally, the comparator/amplifier 51 of the comparing means 50 does not output any injected dampening solution detection secondary signal, and the output end Q of the flipflop circuit 71 keeps operating without releasing the output state of the H signal. Thus, the H signal is kept entered from the flipflop circuit 71 into the abnormality judgment means 90.

The AND circuit 91 of the abnormality Judgment means 90 does not output any abnormality judgment signal because the H signal of the flipflop circuit 71 of the intermediate processing means 70 has not been entered at the time when the preceding nozzle opening signal was entered.

Next, a succeeding nozzle opening signal is generated by the nozzle operation controller 200, and the solenoid excitation signal is generated by this signal to open the nozzle 132, while the nozzle opening signal is entered into the flipflop circuit 71 of the intermediate processing means 70 and the AND circuit 91 of the abnormality Judgment means 90.

At this point of time, the output state of the H signal caused by the preceding nozzle opening signal continues in the flipflop circuit 71 of the intermediate processing means 70, and does not change even if a succeeding nozzle opening signal is entered.

Since the H signal of the flipflop circuit 71 of the intermediate processing means 70 that is kept generated by the preceding nozzle opening signal at the time when the succeeding nozzle opening signal is received is kept inputted, the AND circuit 91 of the abnormality judgment means 90 outputs an abnormality judgment signal as both the nozzle opening signal from the nozzle operation controller 200 and the H signal of the flipflop circuit 71 are entered simultaneously.

In this way, as the state of injection of the dampening solution injected through the nozzle 132 deviates from the normal state based on the reference voltage level of a threshold value TH set by the resistors VR2 and R15 of the comparing means 50, an abnormality judgment signal indicating abnormality is generated from the AND circuit 91 of the abnormality judgment means 90.

Specific circuits such as the injected dampening solution detecting means 30, the comparing means 50, the intermediate processing means 70 and the abnormality judgment means 90, as described above, may be other than the circuits shown in FIG. 1.

As described above, the abnormality detector for nozzle-type dampening systems according to this invention can positively detect the abnormal injection of dampening solution from each nozzle located upstream of the dampening system by determining the abnormality of the injection of the dampening solution from the nozzle by detecting the voltage generated in accordance with the state of injection of the dampening solution and comparing the voltage level based on the detection signal with a predetermined reference voltage level.

Consequently, this invention can be used in a wide range of applications, the suspension of printing operation by stopping the printer to avoid and solve various inconveniences in printing caused by the abnormal injection of dampening solution from individual nozzles.

The use of the abnormality detector according to this invention enables the operator to know an abnormality in the injection of dampening solution by an appropriate visual or audible signal. This lends itself to detecting and discharging defective printed matter during printing process, and maintaining printing quality, substantially reducing spoilage, improving the operating efficiency of the printer, increasing reliability in printing quality by preventing the shipment of defective printed matter, and eliminating the uneasiness felt by the operator about the shipment of defective printed matter.

What is claimed is:

1. An abnormality detector for nozzle-type dampening systems in printers for causing dampening solution to inject from nozzles onto a receiving area by intermittently opening said nozzles with a nozzle opening signal generated by a nozzle operation controller, characterized in that said abnormality detector comprises electrically conductive members provided in dampening solution flying areas between said nozzles and said receiving area, an injected dampening solution detecting means for detecting voltage generated in accordance with the state of injection of said dampening solution between said nozzles and said electrically conductive members, a comparing means for comparing a detection signal generated by said injected dampening solution detecting means with a preset threshold value, an intermediate processing means that is brought into a signal output state by a nozzle opening signal generated by a nozzle operation controller and releases said signal output state with an output signal from said comparing means, and an abnormality judgment means for generating an abnormality judgment signal when said nozzle opening signal is received from said nozzle operation controller under the state where said abnormality judgment means receives an output signal from said intermediate processing means.

2. An abnormality detector for nozzle-type dampening systems in printers as set forth in claim 1 wherein a plurality of said nozzles are disposed facing a roller means that comes in contact with a printing plate fitted to a plate cylinder, and arranged in the axial direction of said roller means on a nozzle means disposed in parallel with the axial direction of said roller means so as to inject said dampening solution onto said roller means.

3. An abnormality detector for nozzle-type dampening systems as set forth in claim 2 wherein said electrically conductive members are disposed between the periphery of said roller means constituting said receiving area and the injection holes of said individual nozzles so that an electrically conductive state is formed between said individual nozzles and said individual electrically conductive members.

4. An abnormality detector for nozzle-type dampening systems as set forth in claim 3 wherein said individual electrically conductive members are fixedly fitted to covers fitted to said individual nozzles so as to keep the distance thereof from said corresponding nozzle holes constant.

5. An abnormality detector for nozzle-type dampening systems as set forth in claim 2 wherein said nozzle operation controller is provided corresponding to said nozzles so as to open the holes of said individual nozzles for a predetermined period of time at a predetermined timing based on a nozzle opening signal from said nozzle operation controller.

6. An abnormality detector for nozzle-type dampening systems as set forth in claim 3 wherein said injected dampening solution detecting means detects whether a resistance value corresponding to the electrically conductive state produced between said individual nozzles and said individual electrically conductive members exceeds said threshold value and changes.

7. An abnormality detector for nozzle-type dampening systems as set forth in claim 6 wherein said injected dampening solution detecting means has a flipflop circuit that is set by said nozzle opening signal from said nozzle operation controller, and reset based on that said resistance value corresponding to said electrically conductive state exceeds said threshold value and changes, and issues an abnormality judgment signal when an output of said flipflop is kept in a set state until a next timing at which a nozzle opening signal is generated.

* * * * *